US006229518B1

(12) United States Patent
Yu et al.

(10) Patent No.: US 6,229,518 B1
(45) Date of Patent: May 8, 2001

(54) APPARATUS AND METHOD FOR CONTROLLING A SOFTWARE CURSOR

(75) Inventors: Cindy Z. Yu, Delta; Chuan-Huang Chen, Richmond, both of (CA)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/167,836

(22) Filed: Oct. 7, 1998

(51) Int. Cl.[7] ..... G09G 5/00
(52) U.S. Cl. ..... 345/113; 345/114; 345/435
(58) Field of Search ..... 345/145, 159, 345/118, 148, 113, 114, 112, 435

(56) References Cited

U.S. PATENT DOCUMENTS

| | | | | |
|---|---|---|---|---|
| 4,623,880 | | 11/1986 | Bresenham et al. . | |
| 4,982,345 | | 1/1991 | Callahan et al. . | |
| 5,012,433 | | 4/1991 | Callahan et al. . | |
| 5,161,212 | * | 11/1992 | Littleton | 395/118 |
| 5,359,347 | | 10/1994 | Kim et al. | 345/145 |
| 5,369,741 | | 11/1994 | Hartog et al. . | |
| 5,455,897 | | 10/1995 | Nicholl et al. . | |
| 5,491,494 | | 2/1996 | Cornett et al. . | |
| 5,522,020 | | 5/1996 | Narayanaswami . | |
| 5,553,210 | | 9/1996 | Narayanaswami . | |
| 5,559,532 | | 9/1996 | Gardyne | 345/145 |
| 5,594,848 | | 1/1997 | Dao . | |
| 5,598,183 | | 1/1997 | Robertson et al. | 345/145 |
| 5,668,571 | | 9/1997 | Pai et al. | 345/113 |
| 5,720,019 | | 2/1998 | Koss et al. . | |
| 5,745,009 | | 4/1998 | Blomqvist | 345/145 |

OTHER PUBLICATIONS

*Addison–Wesley, "Programmer's Guide to the EGA, VGA and Super VGA Cards"*, 3rd Edition, 1994, pp. 153, 154, 554–557 and 732–733, Richard F. Ferraro.
Addison–Wesley, "Programmer's Guide to the EGA, VGA and Super VGA Cards", 3 rd Edition, 1994, pp. 153, 154, 554–557 and 732–733, Richard F. Ferraro.*

* cited by examiner

*Primary Examiner*—Matthew Luu
*Assistant Examiner*—Daniel Chung

(57) ABSTRACT

Apparatus and methods perform an improved cursor controlling technique by determining a spatial relationship between a graphics element and a cursor, and then writing the graphics element without turning off the cursor if the graphics element and the cursor do not overlap.

24 Claims, 6 Drawing Sheets

APPARATUS AND METHOD FOR CONTROLLING A SOFTWARE CURSOR

BACKGROUND OF THE INVENTION

A. Field of the Invention

The present invention relates generally to controlling a cursor, and in particular to an apparatus and method for selectively controlling a software cursor in connection with writing a graphics element.

B. Description of the Related Art

Conventional graphics systems use a graphics engine that receives commands from an application program and executes instructions based on the commands. Executing the instructions causes the graphics engine to write graphics elements to a graphics buffer. The information is then read from the buffer and displayed to a user on a screen.

A user interacts with a conventional system with a variety of user input devices, some of which manipulate a cursor on the screen. For example, users often manipulate the cursor using a mouse or keyboard. Thus, the graphics engine writes both graphics information and cursor information to the graphics buffer.

In conventional systems, the graphics engine excludes a software cursor (i.e., turns the cursor off) to draw a graphics element that overlaps the cursor area. After the graphics element is drawn, the graphics engine redraws the cursor (i.e., turns the cursor back on). Thus, in the course of creating a typical drawing having many graphics elements, the graphics engine turns the software cursor off and on many times. This slows down graphics performance and causes the cursor to blink at an undesirably high frequency. Since overlapping is fundamental in any graphics application, however, there is a need to develop an effective technique that reduces the number of times the software cursor is turned off and on.

SUMMARY OF THE INVENTION

An apparatus consistent with this invention for controlling a cursor, comprises means for determining whether a graphics element has a predetermined spatial relationship to a cursor area; means for writing the graphics element without turning the cursor off if the graphics element does not have the predetermined spatial relationship to the cursor area; and means for turning the cursor off when writing the graphics element if the graphics element has the predetermined spatial relationship to the cursor area.

Both the foregoing general description and the following detailed description are exemplary and explanatory only and do not restrict the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention.

DETAILED DESCRIPTION OF THE PREFERRED EMBODIMENTS

Reference will now be made in detail to an example of a cursor controlling technique consistent with the claimed invention shown in the accompanying drawings. In this example, the cursor controlling technique is applied to a software cursor, so that the frequency of turning the cursor off and on is reduced.

Figure 1:
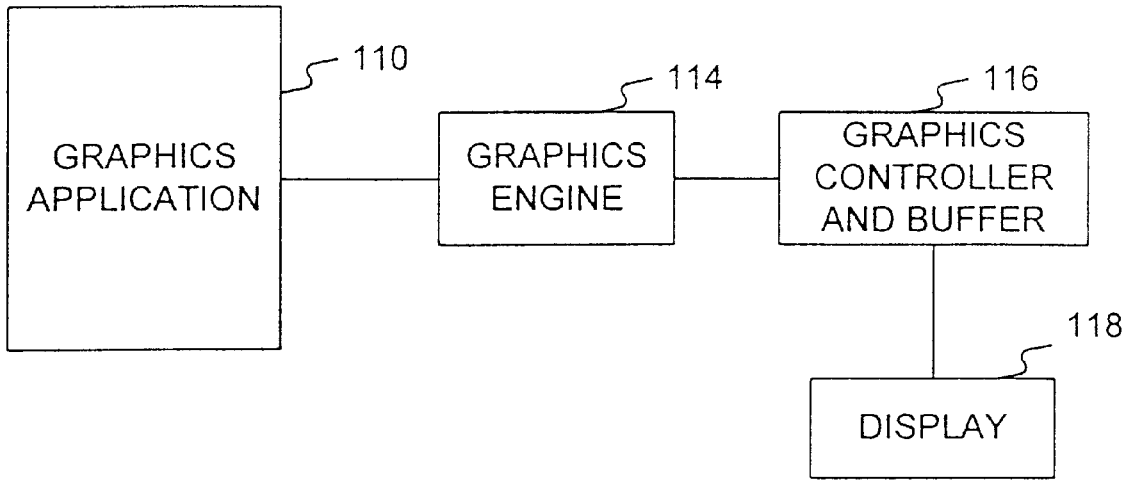
FIG. 1 is a block diagram of a graphics system in which a cursor controlling technique consistent with the claimed invention may be practiced.

FIG. 1 is a block diagram of a graphics system in which a cursor controlling technique consistent with the claimed invention may be practiced. The graphics system includes graphics application 110, graphics engine 114, graphics controller and graphics buffer 116, and display Graphics engine 114 receives graphics commands from application 110, executes the commands, and writes bit-mapped graphics elements information corresponding to the commands to graphics controller 116. Application 110 represents one or more application programs that provide graphics commands to graphics engine 114. Graphics engine 114 also coordinates writing of the graphics elements and the cursor to graphics controller 116 so that the cursor and graphics elements are properly displayed on display 118.

Graphics engine 114 implements an improved apparatus and performs an improved method for controlling a cursor. For example, graphics engine 114 can implement an improved apparatus and method for controlling a cursor by writing graphics element to graphics controller 116 in accordance with the relationship between the cursor and graphics elements. Based on the graphics commands received from application 110, graphics engine 114 writes the graphics elements to graphics controller 116 and controls the cursor based on a predetermined spatial relationship between the graphics elements and the cursor. In particular, graphics engine 114 analyzes the relationship between the graphics elements being written to graphics controller 116 and the cursor information, which includes information regarding size and location of the cursor, and selectively writes the graphics elements information to graphics controller 116 in a manner that reduces the number of times that the cursor is turned off and on. This process also reduces processing overhead, which provides information to graphics controller 116 at a higher rate. Therefore, the visual appearance of the graphics elements and cursor displayed on display 118 is enhanced.

Figure 2:
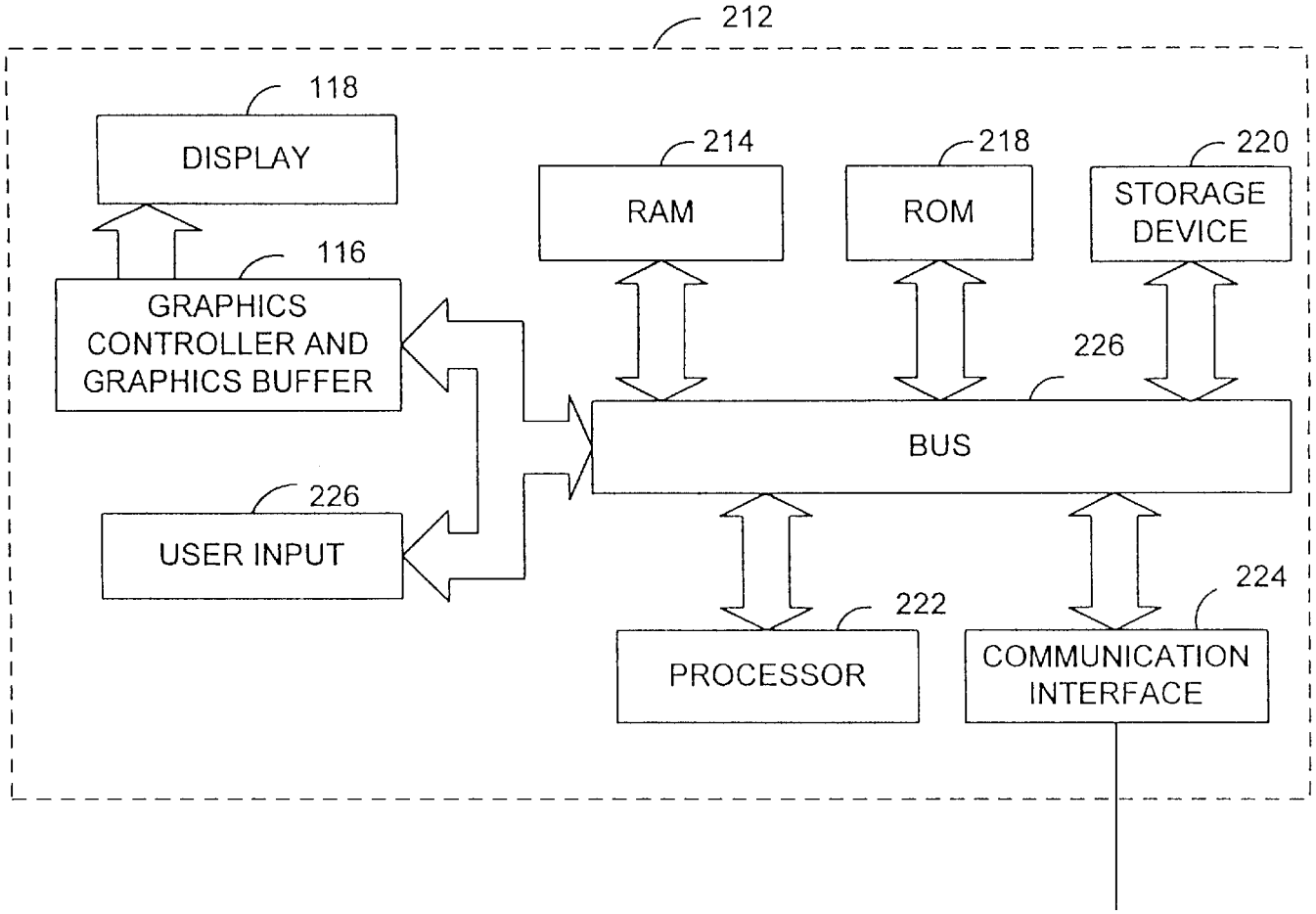
FIG. 2 is a block diagram of a computer system that may be used to implement the a cursor controlling technique consistent with the claimed invention.

FIG. 2 is a block diagram of a graphics system that may be used to implement the architecture shown in FIG. 1, and implement the improved cursor control technique. In one embodiment, computer system 212 is a general purpose computer system, such as a conventional personal computer or laptop computer, that includes RAM 214, ROM 218, storage device 220, processor 222, and communication interface 224, all interconnected by bus 226. Bus 226 also connects to user input 228 and graphics controller 116. Display 118 is connected to graphics controller 116. User input 228 may be one or more user input devices, such as a keyboard, joystick, or mouse. Display 118 may be a CRT or other type of display device.

RAM 214, or a similar dynamic storage device, stores programs comprised of instructions for implementing application program 110 and graphics engine 114. These instructions are executed by processor 222. In one embodiment, graphics controller 116 may contain the cursor controlling algorithm of the present invention.

ROM 218 is used for storing static information and instructions used by processor 222. Storage device 220, such as a magnetic or optical disk, also stores instructions and data used in the operation of computer system 212.

The apparatus and methods consistent with the invention may be implemented by computer system 212 using hardware, software, or a combination of hardware and software. For example, those apparatus and methods described may be implemented as a program in any one or more of RAM 214, ROM 218, or storage device 220. In one embodiment, processor 222 executes programs to control a cursor.

Such programs may be read into RAM 214 from another computer-readable medium, such as storage device 220. Execution of sequences of instructions contained in RAM 214 causes processor 222 to perform the improved cursor controlling technique consistent with the present invention described herein. Hard-wired circuitry or firmware may also be used in place of or in combination with software instructions to implement the invention. Thus, systems and methods consistent with this invention are not limited to any specific combination of hardware circuitry and software.

The term "computer-readable medium" refers to any medium that participates in providing instructions to processor 222 for execution. Such a medium may take many forms, including but not limited to, non-volatile memory media, volatile memory media, and transmission media. Non-volatile memory media includes, for example, optical or magnetic disks, such as storage device 220. Volatile memory media includes RAM. Transmission media includes coaxial cables, copper wire and fiber optics, including the wires in bus 226. Transmission media can also take the form of acoustic or light waves, such as those generated during radio wave and infrared data communications.

Common forms of computer-readable media include a floppy disk, a flexible disk, hard disk, magnetic tape, or any other magnetic storage medium, a CD-ROM, any other optical medium, punch cards, paper tape, any other physical medium with patterns of holes, a RAM, a PROM, an EPROM, a FLASH-EPROM, any other memory chip or cartridge, a carrier wave as described hereinafter, or any other medium from which a computer can read and use.

Various forms of computer readable media may be involved in carrying one or more sequences of instructions to processor 222 for execution. For example, the instructions may initially be carried on a magnetic disk or a remote computer. The remote computer can load the instructions into its dynamic memory and send them over a telephone line using a modem. A modem local to computer system 212 can receive the data on the telephone line and use an infrared transmitter to convert the data to an infrared signal. An infrared detector coupled to appropriate circuitry can receive the data carried in the infrared signal and place the data on bus 226. Bus 226 carries the data to RAM 214, from which processor 222 retrieves and executes the instructions. The instructions received by RAM 214 may also be stored on storage device 220 either before or after execution by processor 222.

Computer system 212 also includes a communication interface 224 coupled to bus 226. Communication interface 224 provides two-way communications to other systems. For example, communication interface 224 may be an ISDN card or a modem to provide a data communication connection to a corresponding type of telephone line. Communication may also be, for example, a LAN card to provide communication to a LAN. Communication interface 224 may also be a wireless card for implementing wireless communication between computer system 212 and wireless systems. In any such implementation, communication interface 224 sends and receives electrical, electromagnetic or optical signals that carry data streams representing various types of information.

The link between communication interface 224 and external devices and systems typically provides data communication through one or more networks or other devices. For example, the link may provide a connection to a local network (not shown) to a host computer or to data equipment operated by an Internet Service Provider (ISP). An ISP provides data communication services through the Internet. Local networks and the Internet both use electrical, electromagnetic or optical signals that carry digital data streams. The signals through the various networks and the signals between the networks and communication interface 224, which carry the digital data to and from computer system 212, are exemplary forms of carrier waves transporting the information.

Computer system 212 can send messages and receive data, including program code, through the network(s) via the link between communication interface 224 and the external systems and devices. In the Internet, for example, a server might transmit a requested code for an application program through the Internet, an ISP, a local network, and communication interface 224.

Processor 222 can execute program code received over the network as it is received, and/or storage device 220 can store the code in memory for later execution. In this manner, computer system 212 may obtain application code in the form of a carrier wave.

Figure 3:
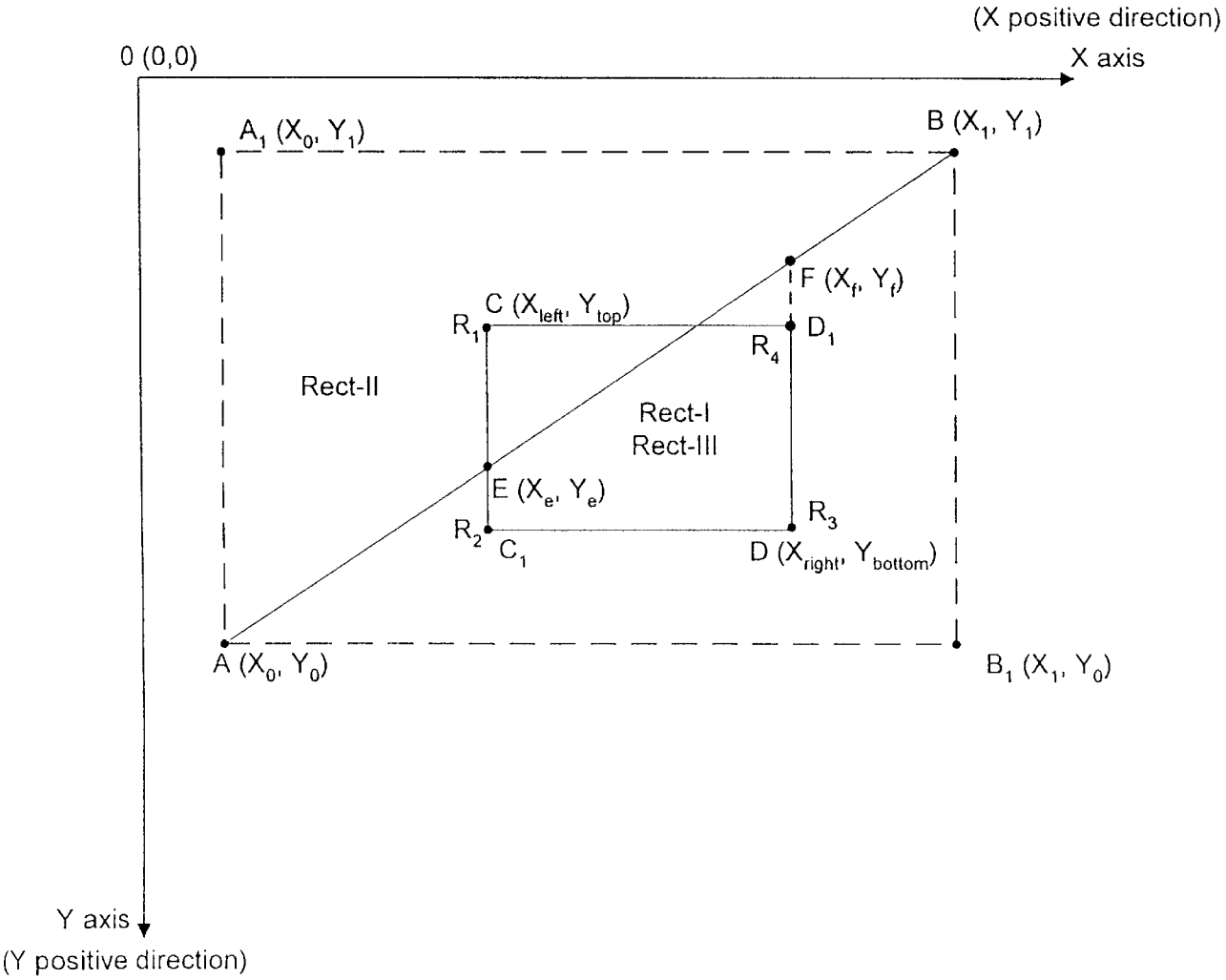
FIG. 3 is a block diagram illustrating the analysis performed by the graphics engine of FIG. 1 when writing a line segment and controlling a cursor.

FIG. 3 is a block diagram that illustrates the analysis performed by graphics engine 114 when writing line segment AB (which may be a component of a graphics element) and controlling a cursor defined by rectangle $CD_1DC_1$. Graphics engine 114 first determines whether there is an overlapping relationship between line segment AB and the cursor, to determine whether the cursor must be turned off while writing line segment AB, and then turned on again. If there is no overlap, the cursor will be left on, thus saving valuable processing time.

The X and Y axes represent the coordinate system of display 118. The horizontal line across the top represents the X axis in a positive direction, and the vertical line along the left side represents the Y axis in a positive direction. The intersection of the X and Y axis in the upper left corner represents coordinate position 0, 0. The cursor is represented by Rect-I, which corresponds to points $CD_1DC_1$. Point C has coordinates $X_{left}$, $Y_{top}$, and point D has coordinate $X_{right}$, $Y_{bottom}$.

Line segment AB is defined by point A having coordinates $X_0$, $Y_0$, and point B having coordinates $X_1$, $Y_1$. To determine the possibility of an overlapping relationship between line segment AB and the cursor area, graphics engine 114 designates the leftmost point of line segment AB as point A, and the rightmost point of line segment AB as point B. Graphics engine 114 also forms a logical rectangle, Rect-II, using line segment AB as the diagonal (shown in broken line in FIG. 3). Apparatus and methods consistent with this invention, such as those shown in FIGS. 1 and 2, analyze the relationship between cursor Rect-I and line segment AB rectangle Rect-II to determine whether line segment AB overlaps cursor area $CD_1DC_1$. Graphics engine 114 only turns the cursor off when the two overlap, which reduces the processing overhead when it is not necessary to turn the cursor off and on.

Figure 4:
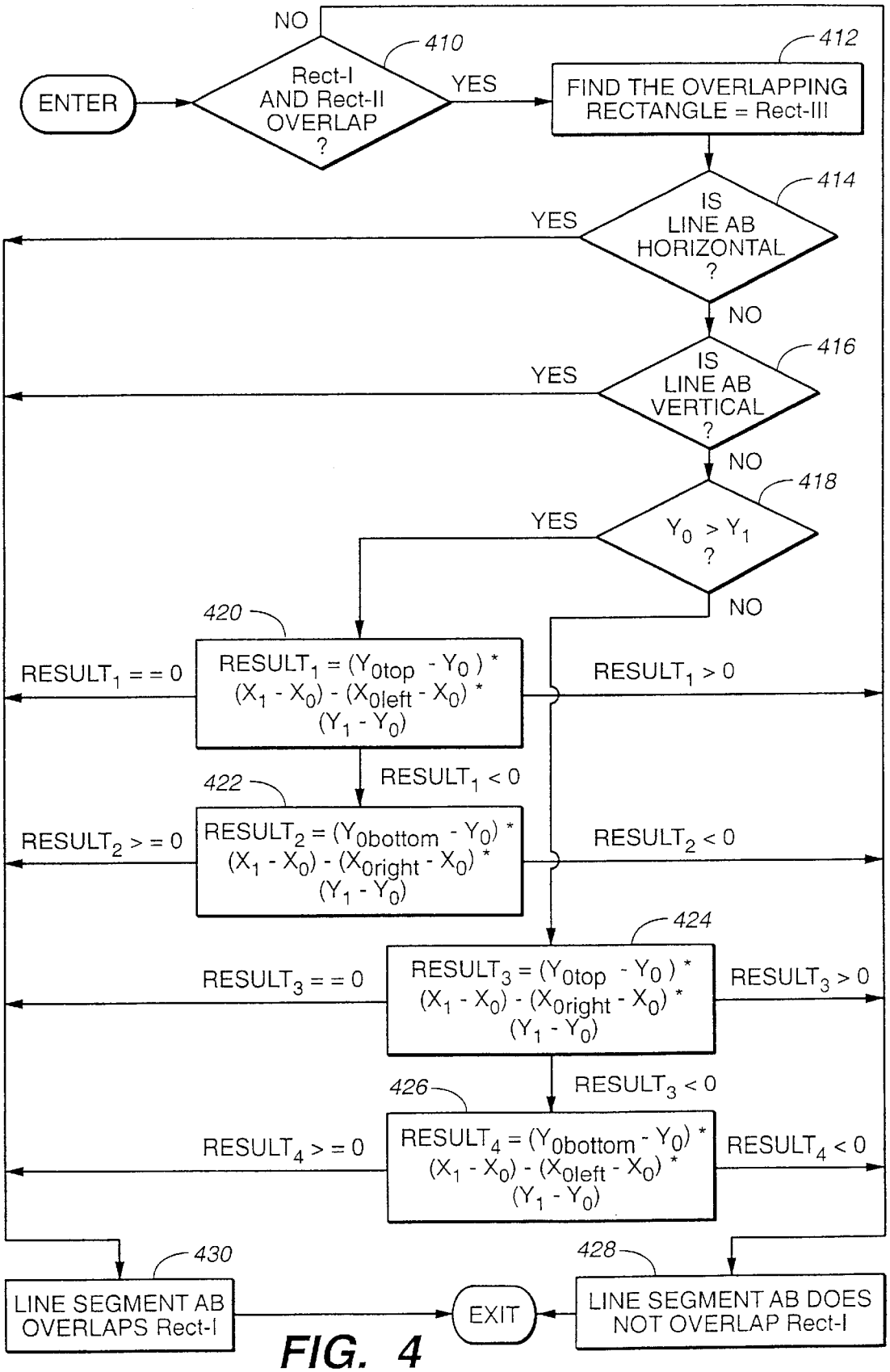
FIG. 4 is a flowchart showing the processing performed by the graphics engine of FIG. 1.

FIG. 4 is a flowchart showing the processing performed by graphics engine 114 when writing to graphics buffer 116 a graphics element defined by a graphics command received from application 110. Graphics engine 114 begins the process by determining whether cursor area Rect-I overlaps line segment AB rectangle Rect-II, which is based on the graphics element to be drawn, line segment AB. Rect-II is defined by forming a rectangle having line segment AB as a diagonal. In particular, Rect-II is formed by point $A_1$ $(X_0, Y_1)$, B $(X_1, Y_1)$, $B_1$ $(X_1, Y_0)$, and A $(X_0, Y_0)$. If there is no overlap between Rect-I and Rect-II (step 410), then line segment AB does not overlap cursor area Rect-I (step 428), and the process is exited. In that case, line segment AB does not overlap cursor area Rect-I, so graphics engine 114 can draw line AB without turning off the cursor.

If graphics engine 114 determines that Rect-I and Rect-II overlap (step 410), graphics engine 114 determines the precise overlapping region, Rect-III (step 412). The coordinates of the corner points of Rect-III are as follows: top left $(X_{0left}, Y_{0top})$, bottom right $(X_{0right}, Y_{0bottom})$, top right $(X_{0right}, Y_{0top})$, and bottom left $(X_{0left}, Y_{0bottom})$.

Graphics engine 114 then determines whether line segment AB is horizontal (step 414). If so, line segment AB overlaps Rect-I (step 430) and the process is exited. If line segment AB overlaps Rect-I, graphics engine 114 will turn the cursor off before writing graphics element AB and then turn the cursor back on.

If line segment AB is not horizontal (step 414), then graphics engine 114 determines whether line segment AB is vertical (step 416). If so, line segment AB overlaps Rect-I (step 430) and graphics engine 114 exits processing. If line segment AB is not vertical, graphics engine 114 determines whether the Y value of the leftmost endpoint $(Y_0)$ is greater than the Y value of the rightmost point $(Y_1)$ of line segment AB (i.e., whether $Y_0$ is greater than $Y_1$) (step 418). If $Y_0$ is less than $Y_1$, meaning that line segment AB slopes down and to the right, processing continues at step 424. If $Y_0$ is greater than $Y_1$, meaning that line segment AB slopes up and to the right, processing continues (step 420).

At that point, graphics engine 114 determines a value $RESULT_1=(Y_{0top}-Y_0)*(X_1-X_0)-(X_{0left}-X_0)*(Y_1-Y_0)$ (step 420). If $RESULT_1$ is greater than zero, then line segment AB does not overlap Rect-I (step 428), and graphics engine 114 can draw line segment AB without turning off the cursor. If $RESULT_1$ equals zero, then line segment AB overlaps Rect-I (step 430), which requires graphics engine to turn the cursor off while writing line segment AB, and then turn the cursor back on. Finally, if $RESULT_1$ is less than zero, processing continues, and graphics engine 114 computes the result by computing $RESULT_2=(Y_{0bottom}-Y_0)*(X_1-X_0)-(X_{0right}-X_0)*(Y_1-Y_0)$ (step 422). If $RESULT_2$ is less than zero, line segment AB does not overlap Rect-I (step 428), and graphics engine 114 exits the process. If $RESULT_2$ is greater than or equal to zero in 422, graphics engine 114 will turn the cursor off, draw line segment AB, and turn the cursor back on, because line segment AB overlaps Rect-I (step 430).

If $Y_0$ is not greater than $Y_1$, graphics engine 114 determines the value $RESULT_3=(Y_{0top}-Y_0)*(X_1-X_0)-(X_{0right}-X_0)*(Y_1-Y_0)$. If t $RESULT_3$ is greater than zero, graphics engine 114 can draw line segment AB without turning the cursor off, because line segment AB does not overlap Rect-I (step 428).

If $RESULT_3$ equals zero, then line segment AB overlaps Rect-I (step 430), and graphics engine 114 must turn the cursor off, draw line segment AB, and turn the cursor back on. If $RESULT_3$ is less than zero, processing continues to step 426, which determines $RESULT_4=(Y_{0bottom}-Y_0)*(X_1-X_0)-(X_{0left}-X_0)*(Y_1-Y_0)$.

If $RESULT_4$ is less than zero, line segment AB does not overlap Rect-I (step 428). If $RESULT_4$ is greater than or equal to zero, line segment AB overlaps Rect-I (step 430).

The equation for line segment AB is defined by RESULT $(X,Y)=(Y-Y_0)*(X_1-X_0)-X-X_0)*(Y_1-Y_0)$. For all points on line segment AB, RESULT (X,Y) has a value of zero. For any point in Region II, below line segment AB, RESULT (X,Y) has a positive value. For any point in Region I, which is above line segment AB, RESULT (X,Y) has a negative value. In each figure, the end point of line segment AB having the smallest X coordinate value is defined as point A. The other end point is defined to be point B.

Figure 5:
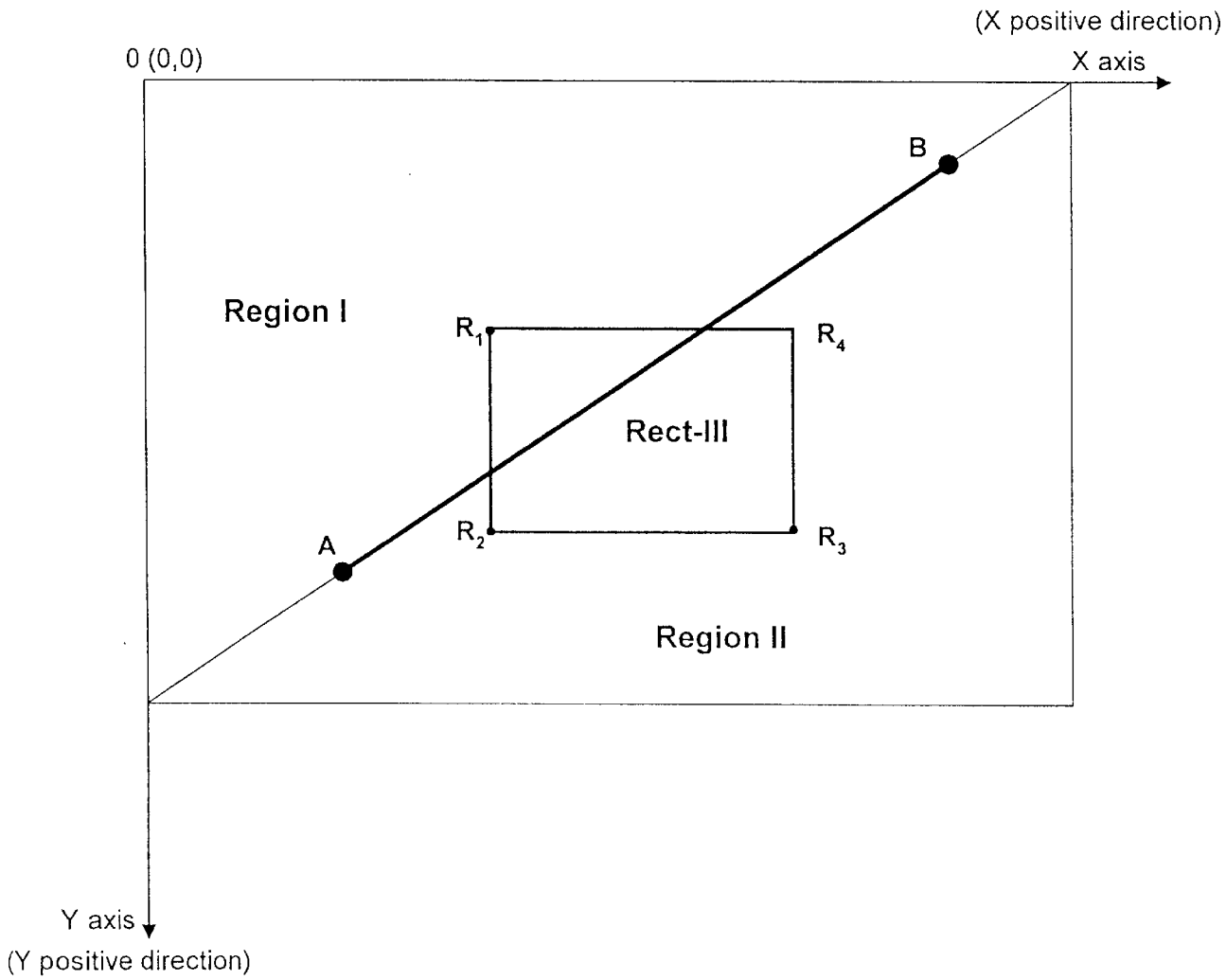
FIG. 5 illustrates an relationship consistent with this invention between a line segment AB and a cursor where line segment AB slopes up.

In FIG. 5, the position of the upper left corner (point $R_1$) and the position of the lower right corner (point $R_3$) are compared relative to line segment AB to determine if line segment AB intersects rectangle $R_1R_2R_3R_4$. Line segment AB does not intersect rectangle $R_1R_2R_3R_4$, if either points $R_1$ and $R_3$ are both above the line segment AB in Region I or below line segment AB in Region II. In all other situations, line segment AB will intersect rectangle $R_1R_2R_3R_4$.

Figure 6:
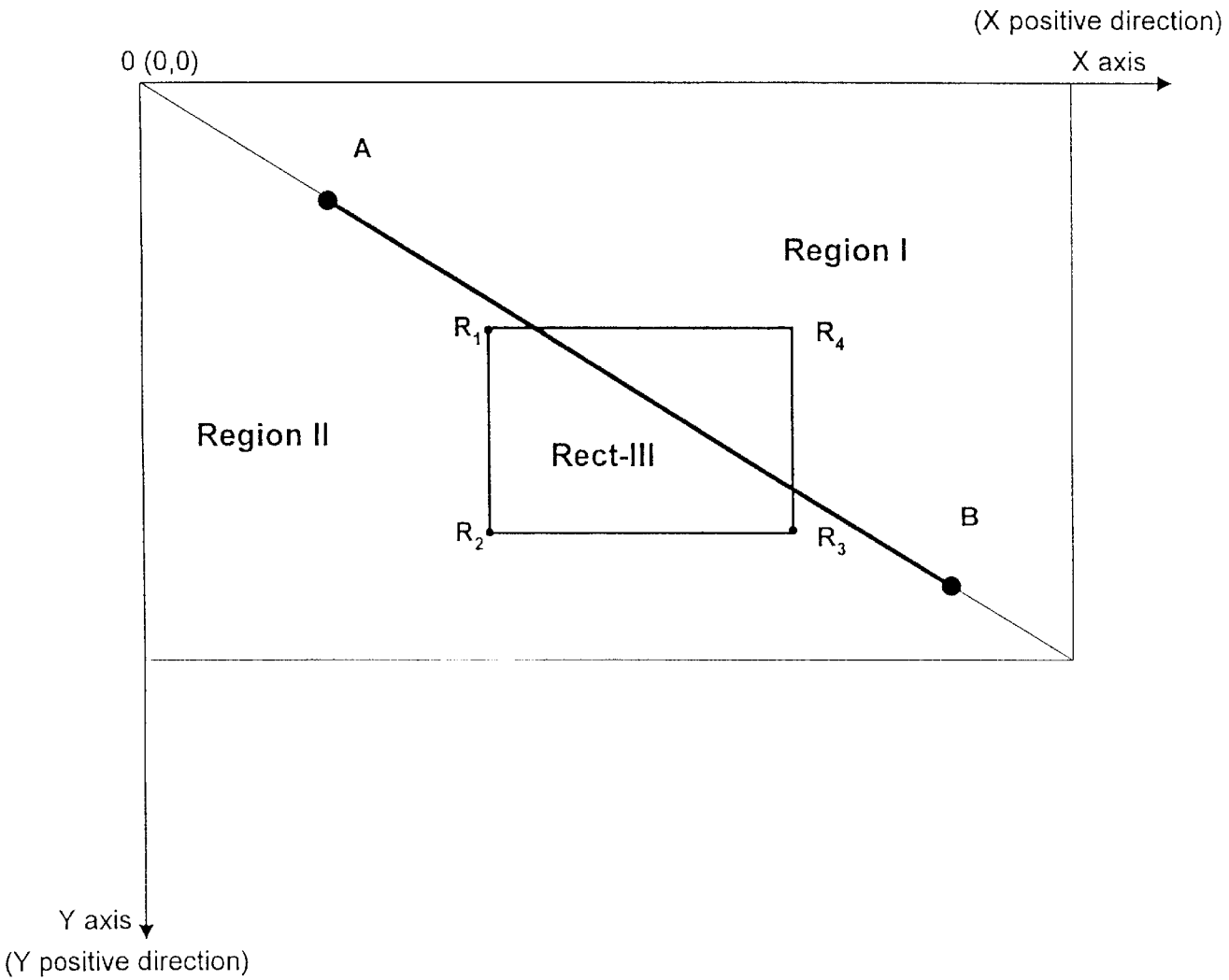
FIG. 6 illustrates an relationship between a line segment AB and a cursor where line segment AB slopes down.

In FIG. 6, the position of the upper right corner (point $R_4$) and the position of the lower left corner (point $R_2$) are compared relative to line segment AB to determine if line segment AB intersects rectangle $R_1R_2R_3R_4$. Line segment AB does not intersect rectangle $R_1R_2R_3R_4$, if either point $R_4$ and $R_2$ are above line segment AB in region I or both point $R_4$ and $R_2$ are below line segment AB in Region II. In any other situation, line segment AB will intersect rectangle $R_1R_2R_3R_4$.

CONCLUSION

It will be apparent to those skilled in the art that various modifications and variations can be made in the improved cursor controlling technique of the present invention and in construction of an apparatus and method consistent with the improved technique without departing from the scope or spirit of the invention. For example, the improved cursor controlling technique can be used in a system other than the system of FIGS. 1 and 2. The apparatus and method may be embodied entirely in hardware, entirely in software, or in a combination of hardware and software. If the apparatus or method consistent with the improved cursor controlling technique is embodied in whole or in part in software, then the software can be embodied on any computer-readable or useable medium, such as a memory, a disk, or a signal on a line.

Other embodiments of the invention will be apparent to those skilled in the art from consideration of the specification and practice of the disclosed embodiments. The specification and examples are exemplary only, and the true scope and spirit of the invention is defined by the following claims and their equivalents.

What is claimed is:

1. An apparatus for controlling a cursor, comprising:

means for determining whether a graphics element has a predetermined spatial relationship to a cursor area, the means for determining comprising means for defining the cursor area with a first rectangle, means for forming a second rectangle based on the graphics element, means for discerning whether the first and second rectangles overlap and, if so, discerning the overlapping region, means for discerning the orientation of the graphics element, and means for discerning whether the graphics element overlaps the first rectangle by comparing at least one vertex of the overlapping region with a mathematical representation of the graphics element;

means for writing the graphics element without turning the cursor off if the graphics element does not overlap the first rectangle, as determined by the determining means; and means for turning the cursor off when writing the graphics element if the graphics element overlaps the first rectangle, as determined by the determining means.

2. The apparatus according to claim 1, wherein the graphics element is a line forming a diagonal of the second rectangle, and wherein the means for discerning the orientation of the graphics element determines whether the line is horizontal, vertical, or neither.

3. The apparatus according to claim 1, wherein the cursor is a software cursor.

4. A method for controlling a cursor, comprising:

determining whether a graphics element has a predetermined spatial relationship to a cursor area, the determining comprising defining the cursor area with a first rectangle, forming a second rectangle based on the graphics element, discerning whether the first and second rectangles overlap and, if so, discerning the overlapping region, discerning the orientation of the graphics element if the overlapping region exists, and depending on the result of the orientation discerning step, discerning whether the graphics element overlaps the first rectangle by comparing at least one vertex of the overlapping region with a mathematical representation of the graphics element;

writing the graphics element without turning the cursor off if the graphics element does not overlap the first rectangle, as determined in the determining step; and turning the cursor off when writing the graphics element if the graphics element overlaps the first rectangle, as determined in the determining step.

5. The method according to claim 4, wherein the graphics element is a line forming a diagonal of the second rectangle, and wherein the step of discerning the orientation of the graphics element comprises determining whether the line is horizontal, vertical, or neither.

6. The method according to claim 4, wherein the cursor is a software cursor.

7. A system for controlling a cursor, comprising:

means for displaying;

means for providing a command requesting that a graphics element be written to the means for displaying;

means for determining whether the graphics element has a predetermined spatial relationship to a cursor area, the means for determining comprising means for defining the cursor area with a first rectangle, means for forming a second rectangle based on the graphics element, means for discerning whether the first and second rectangles overlap and, if so, discerning the overlapping region, means for discerning the orientation of the graphics element, and means for discerning whether the graphics element overlaps the first rectangle by comparing at least one vertex of the overlapping region with a mathematical representation of the graphics element;

means for writing the graphics element without turning the cursor off if the graphics element does not overlap the first rectangle, as determined by the determining means; and means for turning the cursor off when writing the graphics element if the graphics element overlaps the first rectangle, as determined by the determining means.

8. The system according to claim 7, wherein the graphics element is a line forming a diagonal of the second rectangle, and wherein the means for discerning the orientation of the graphics element determines whether the line is horizontal, vertical, or neither.

9. The system according to claim 7, wherein the cursor is a software cursor.

10. A computer-readable medium containing instructions to perform a method for controlling a cursor, the method comprising:

determining whether a graphics element has a predetermined spatial relationship to a cursor area, the determining comprising defining the cursor area with a first rectangle, forming a second rectangle based on the graphics element, discerning whether the first and second rectangles overlap and, if so, discerning the overlapping region, discerning the orientation of the graphics element if the overlapping region exists, and depending on the result of the orientation discerning step, discerning whether the graphics element overlaps the first rectangle by comparing at least one vertex of the overlapping region with a mathematical representation of the graphics element;

writing the graphics element without turning the cursor off if the graphics element does not overlap the first rectangle, as determined in the determining step;

turning the cursor off when writing the graphics element if the graphics element overlaps the first rectangle, as determined in the determining step.

11. The computer-readable medium according to claim 10, wherein the graphics element is a line forming a diagonal of the second rectangle, and wherein the step of discerning the orientation of the graphics element comprises determining whether the line is horizontal, vertical, or neither.

12. The computer-readable medium according to claim 10, wherein the cursor is a software cursor.

13. An apparatus for controlling a cursor, comprising:

a determiner for determining whether a graphics element has a predetermined spatial relationship to a cursor area, the determiner comprising a first rectangle producer for defining the cursor area with a first rectangle, a second rectangle producer for forming a second rectangle based on the graphics element, and an overlap discerner for discerning whether the first and second rectangles overlap and, if so, discerning the overlapping region, an orientation discerner for discerning the orientation of the graphics element, and a comparator for discerning whether the graphics element overlaps the first rectangle by comparing at least one vertex of the overlapping region with a mathematical representation of the graphics element;

a writer for writing the graphics element without turning the cursor off if the graphics element does not overlap the first rectangle as determined by the determiner; and a cursor controller for turning the cursor off when writing the graphics element if the graphics element overlaps the first rectangle, as determined by the determiner.

14. The apparatus according to claim 13, wherein the graphics element is a line forming a diagonal of the second rectangle, and wherein the orientation discerner determines whether the line is horizontal, vertical, or neither.

15. The apparatus according to claim 13, wherein the cursor is a software cursor.

16. A signal containing instructions to perform a method for controlling a cursor, the method comprising:

determining whether a graphics element has a predetermined spatial relationship to a cursor area, the determining comprising defining the cursor area with a first rectangle, forming a second rectangle based on the graphics element, discerning whether the first and second rectangles overlap and, if so, discerning the overlapping region, discerning the orientation of the graphics element if the overlapping region exists, and depending on the result of the orientation discerning step, discerning whether the graphics element overlaps the first rectangle by comparing at least one vertex of the overlapping region with a mathematical representation of the graphics element;

writing the graphics element without turning the cursor off if the graphics element does not overlap the first rectangle, as determined in the determining step; and turning the cursor off when writing the graphics element if the graphics element overlaps the first rectangle, as determined in the determining step.

17. The signal according to claim 16, wherein the graphics element is a line forming a diagonal of the second rectangle, and wherein the step of discerning the orientation of the graphics element comprises determining whether the line is horizontal, vertical, or neither.

18. The signal according to claim 16, wherein the cursor is a software cursor.

19. The apparatus according to claim 1, wherein the overlapping region comprises an overlapping rectangle and the at least one vertex comprises two diagonally opposed vertices.

20. The method according to claim 4, wherein the overlapping region comprises an overlapping rectangle and the at least on vertex comprises two diagonally opposed vertices.

21. The system according to claim 7, wherein the overlapping region comprises an overlapping rectangle and the at least one vertex comprises two diagonally opposed vertices.

22. The computer-readable medium according to claim 10, wherein the overlapping region comprises an overlapping rectangle and the at least one vertex comprises two diagonally opposed vertices.

23. The apparatus according to claim 13, wherein the overlapping region comprises an overlapping rectangle and the at least one vertex comprises two diagonally opposed vertices.

24. The signal according to claim 16, wherein the overlapping region comprises an overlapping rectangle and the at least one vertex comprises two diagonally opposed vertices.

* * * * *

UNITED STATES PATENT AND TRADEMARK OFFICE

CERTIFICATE OF CORRECTION

PATENT NO. : 6,229,518 B1
DATED : May 8, 2001
INVENTOR(S) : Cindy Yu et al.

It is certified that error appears in the above-identified patent and that said Letters Patent is hereby corrected as shown below:

Column 10,
Line 17, change "on" to -- one --.

Signed and Sealed this

Eighth Day of January, 2002

*Attest:*

*Attesting Officer*

JAMES E. ROGAN
*Director of the United States Patent and Trademark Office*